US008561832B2

(12) United States Patent
Hassell

(10) Patent No.: US 8,561,832 B2
(45) Date of Patent: Oct. 22, 2013

(54) BAKERY TRAY

(75) Inventor: Jon P. Hassell, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 13/543,928

(22) Filed: Jul. 9, 2012

(65) Prior Publication Data

US 2013/0008826 A1 Jan. 10, 2013

Related U.S. Application Data

(60) Provisional application No. 61/505,832, filed on Jul. 8, 2011.

(51) Int. Cl.
*B65D 25/24* (2006.01)

(52) U.S. Cl.
USPC ..... 220/628; 206/386; 206/504; 206/507; 206/509; 206/511; 206/557; 220/607

(58) Field of Classification Search
USPC ..... 220/628; 206/386, 504, 507, 509, 511, 206/557, 607
See application file for complete search history.

(56) References Cited

U.S. PATENT DOCUMENTS

D247,648 S * 3/1978 Carroll et al. ..... D3/312
6,394,274 B1 * 5/2002 Cheeseman ..... 206/511
7,823,728 B2 * 11/2010 Baltz ..... 206/506

* cited by examiner

*Primary Examiner* — Anthony Stashick
*Assistant Examiner* — Elizabeth Volz
(74) *Attorney, Agent, or Firm* — Carlson, Gaskey & Olds

(57) ABSTRACT

A bakery tray includes a base. A front wall extends upward from a front edge of the base. Side walls extend upward from side edges of the base. A rear wall extends upward from a rear edge of the base. The rear wall includes an inner panel portion and an outer lip portion that protrudes outward and then downward from an uppermost edge of the inner panel portion. A plurality of ribs connect the inner panel portion to the outer lip portion. In one feature, the plurality of ribs may include an increased concentration of the ribs in the center of the tray.

12 Claims, 10 Drawing Sheets

BAKERY TRAY

This application claims priority to U.S. Provisional Application Ser. No. 61/505,832 filed Jul. 8, 2011.

BACKGROUND

Plastic injection molded bakery trays are well-known. The bakery trays include a base. Front, rear and side walls extend upward from respective edges of the base. The front wall and rear wall are typically shorter than the side walls. The front wall may include a dropped portion for increased access to the goods in the tray. The side walls may be configured to provide a first stacking height when oriented the same as a tray on which it is stacked and a second stacking height when oriented 180 degrees relative to the tray on which it is stacked.

SUMMARY

A bakery tray includes a base. A front wall extends upward from a front edge of the base. Side walls extend upward from side edges of the base. A rear wall extends upward from a rear edge of the base. The rear wall includes an inner panel portion and an outer lip portion that protrudes outward and then downward from an uppermost edge of the inner panel portion. A plurality of ribs connect the inner panel portion to the outer lip portion.

According to one feature of the tray, the plurality of ribs may include an increased concentration of the ribs in the center of the tray.

According to another feature of the tray, a drag rail extends downward below the base from each side wall. A plurality of ribs connect the drag rails to the base. The plurality of ribs may include an increased concentration of the ribs toward corners of the tray.

According to another feature of the tray, a plurality of corner pads extend downward from the base between the drag rails. The corner pads may extend downward further than the drag rails to reduce wear on the drag rails.

DETAILED DESCRIPTION

Figure 1:
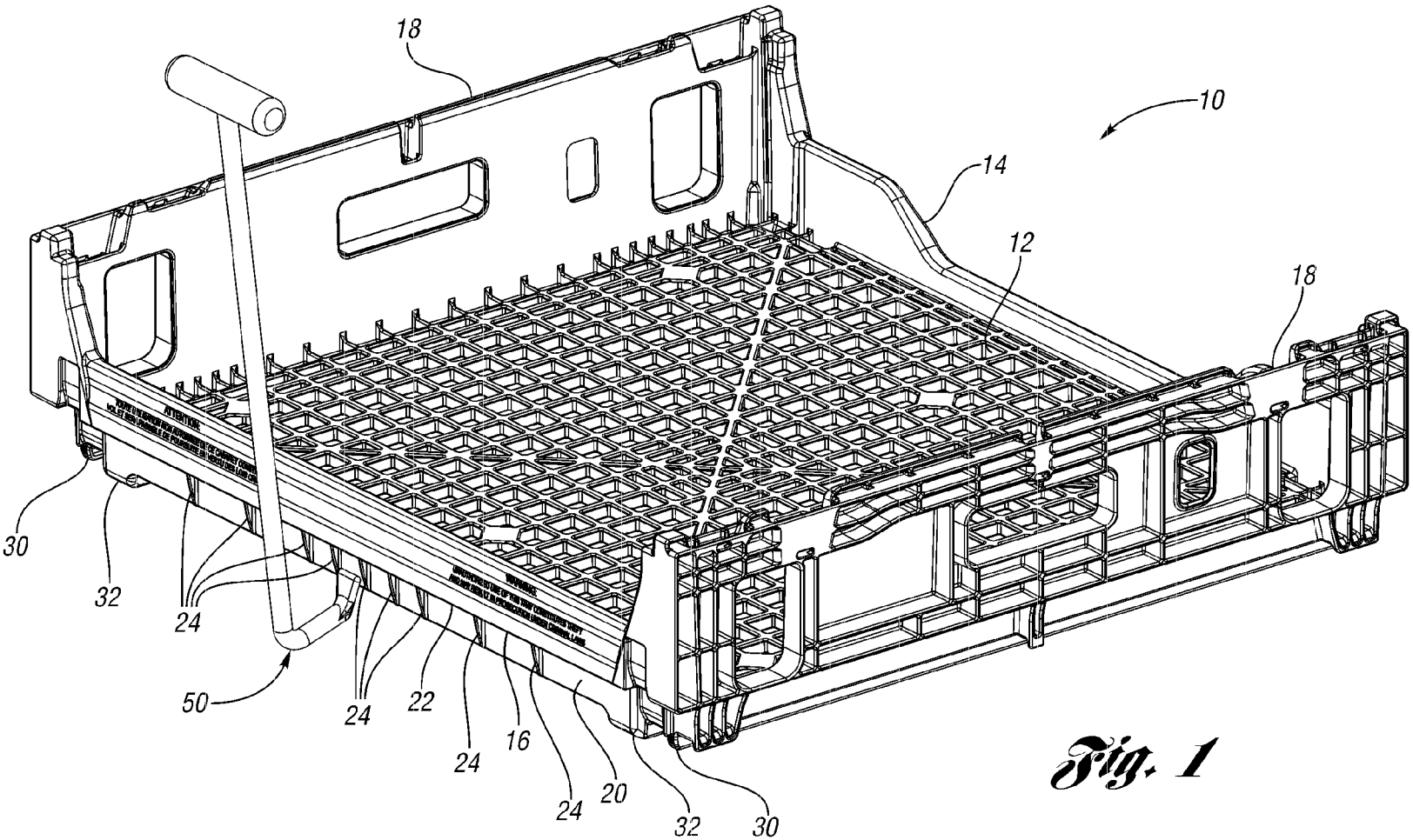
FIG. 1 is a perspective view of a tray according to one embodiment of the present invention and hook that can be used to drag the tray.
Figure 2:
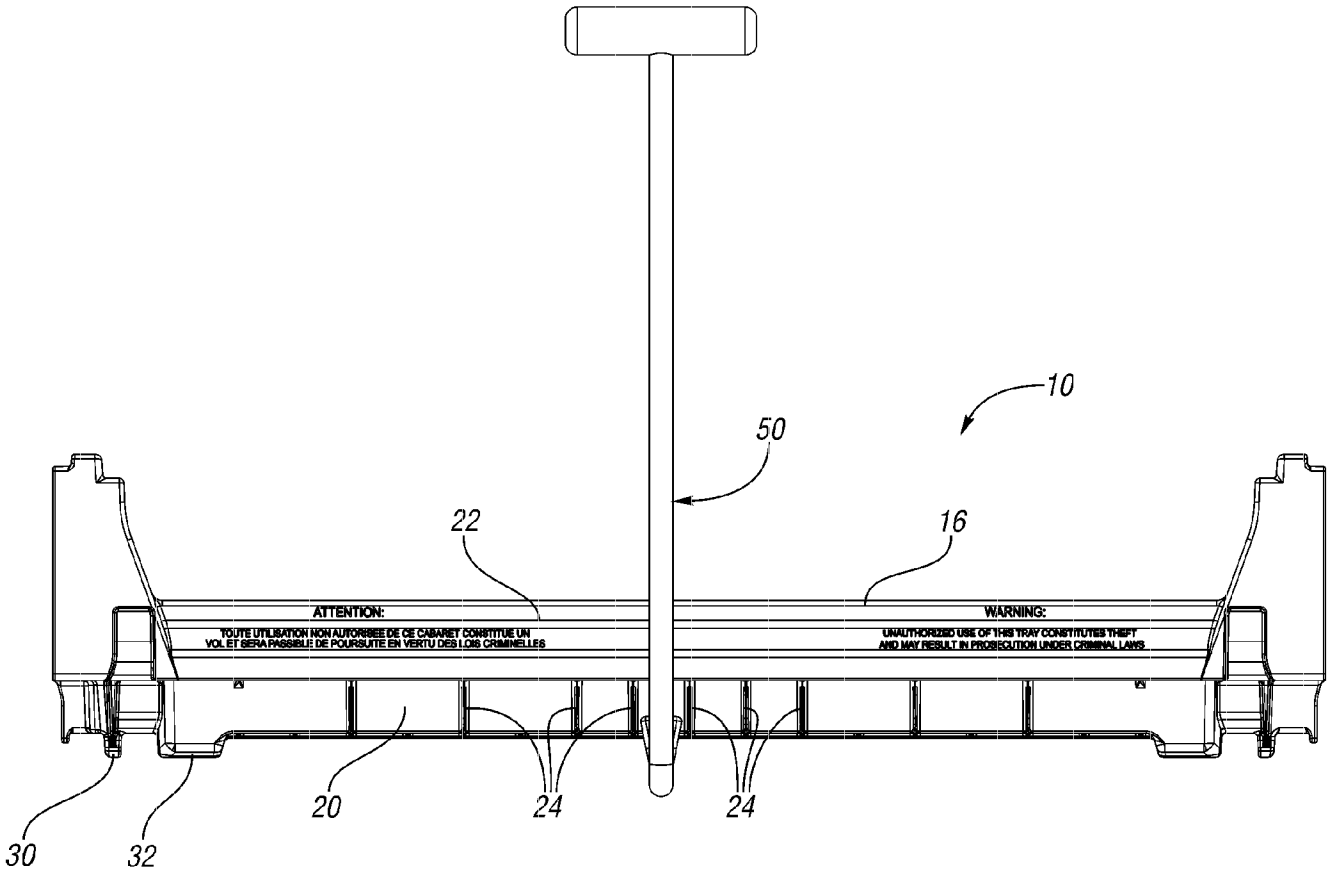
FIG. 2 is a rear view of the tray and hook of FIG. 1.

Referring to FIGS. 1 and 2, a bakery tray 10 includes a base 12. A front wall 14 having a dropped portion or opening providing access to the tray 10, extends upward from a front edge of the base 12. Side walls 18 extend upward from side edges of the base 12. A rear wall 16 extends upward from a rear edge of the base 12. The side walls 14 are approximately twice the height of the front wall 14 and rear wall 16. As shown, the side walls 14 may be configured to provide a first stacking height when oriented the same as a tray (not shown) on which it is stacked and a second stacking height when oriented 180 degrees relative to the tray (not shown) on which it is stacked.

The rear wall 16 includes an inner panel portion 20 and an outer lip portion 22 that protrudes outward and then downward from an uppermost edge of the inner panel portion 20. Ribs 24 connect the inner panel portion 20 to the outer lip portion 22. In the tray 10 according to a first feature of the present invention, there are an increased number of ribs 24 in the center of the tray 10, so that there is an increased concentration (approximately double) of ribs 24 toward the center of the tray 10. For example, in the example tray 10 shown, the center quarter (approximately) of the tray 10 includes two extra ribs 24 while the remainder of the ribs 24 along the rear wall 16 are equally spaced. This increases the strength of the outer lip portion 22 and its attachment to the inner panel portion 20 in the center area of the rear wall 16.

A drag rail 30 extends down below the base 12 from each side wall 18. A corner pad 30 extends down from the base 12 in each corner of the base 12, inward of the drag rails 20.

Figure 3:
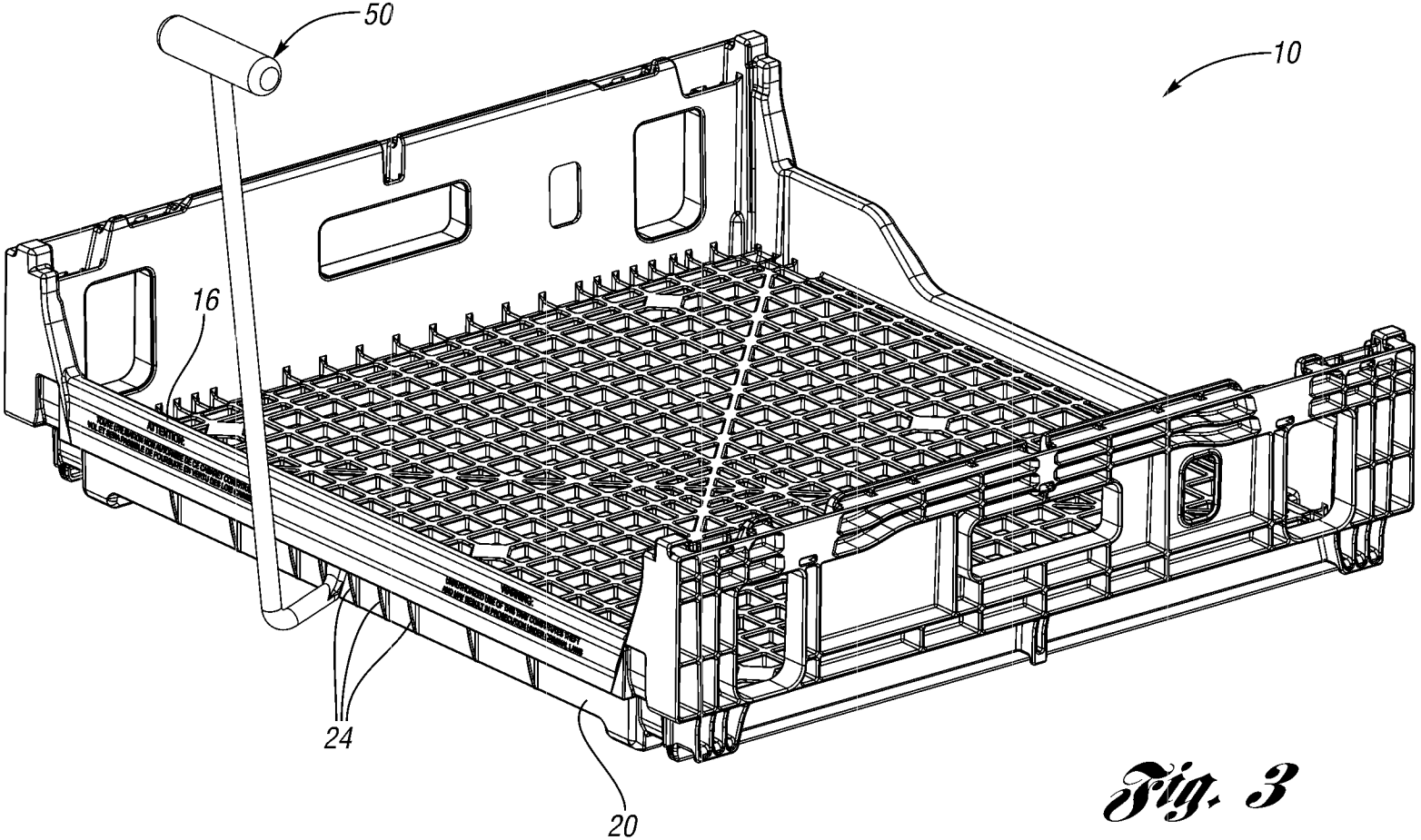
FIG. 3 shows the tray and hook of FIG. 1 with the hook engaging the tray.
Figure 4:
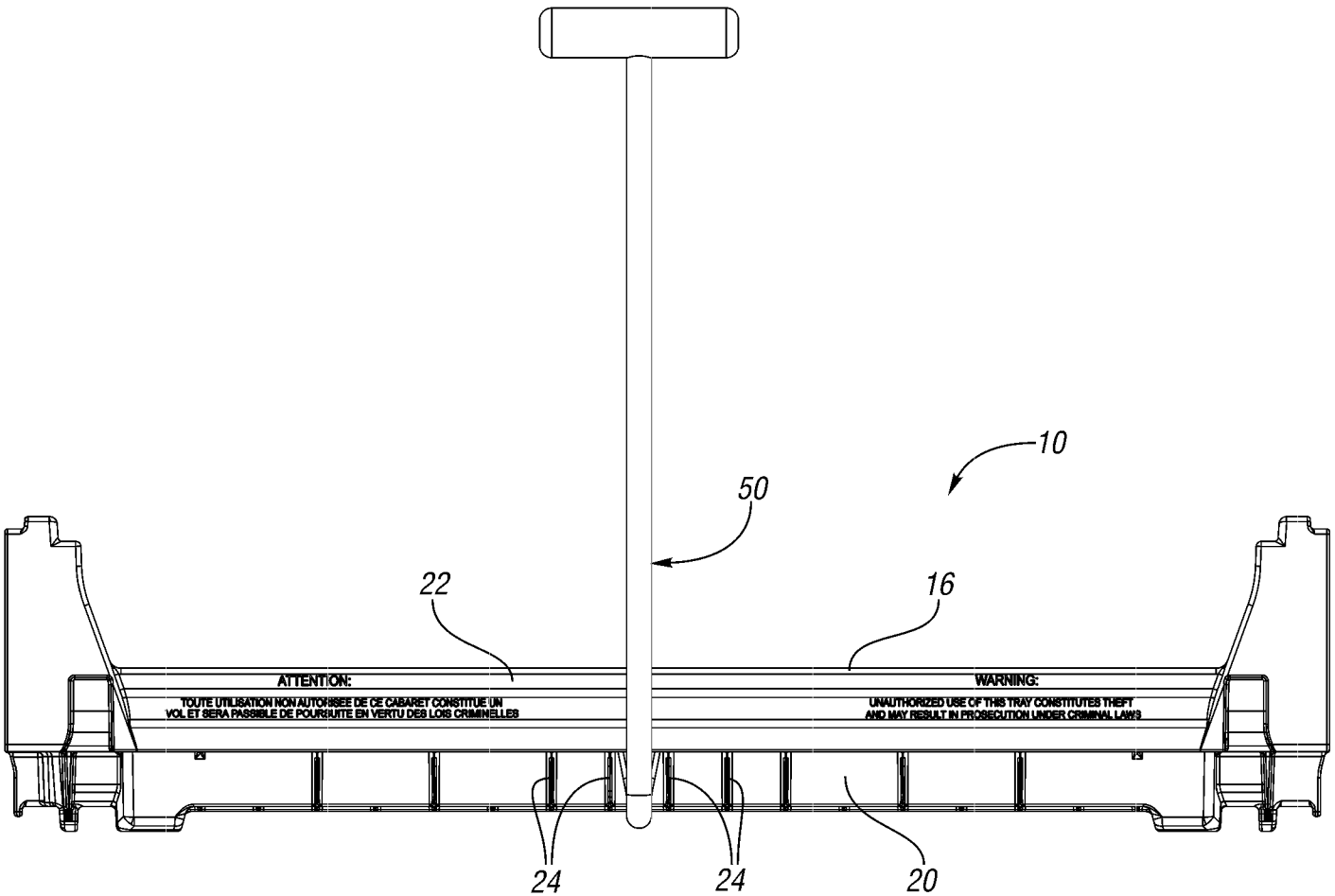
FIG. 4 is a rear view of the tray and hook of FIG. 3.
Figure 5:
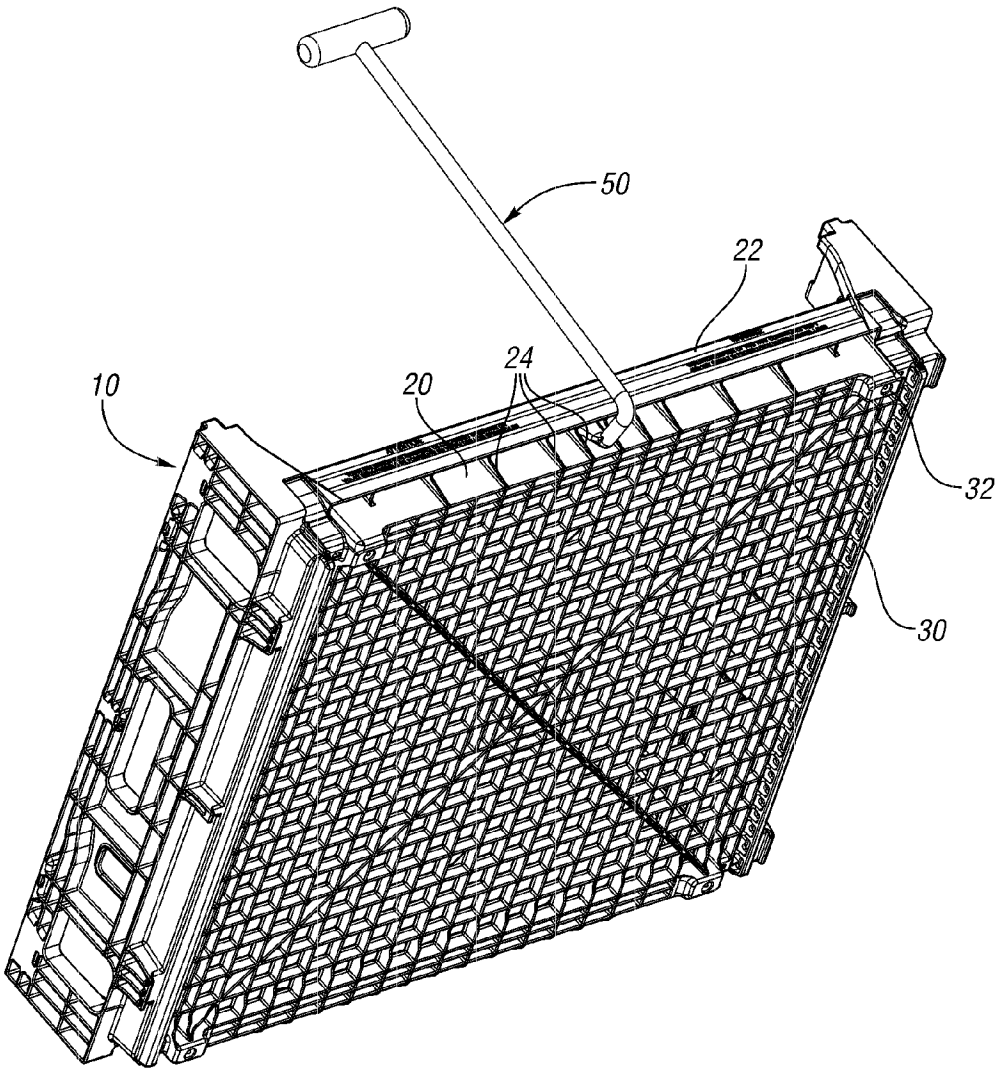
FIG. 5 is a bottom perspective view of the tray and hook of FIG. 3.

As shown in FIGS. 3-5, a hook 50 (e.g. "J-hook) can be inserted between the outer lip portion 22 and the inner panel portion 20. The tray 10 (or a stack of trays 10) may be moved (dragged) by the hook 50. Therefore all of the force is pulling on the outer lip portion 22. The additional ribs 24 in the center of the rear wall 16 reinforce the outer lip portion 22 and transmit the force more evenly to the inner panel portion 20 and to the base 12.

Figure 6:
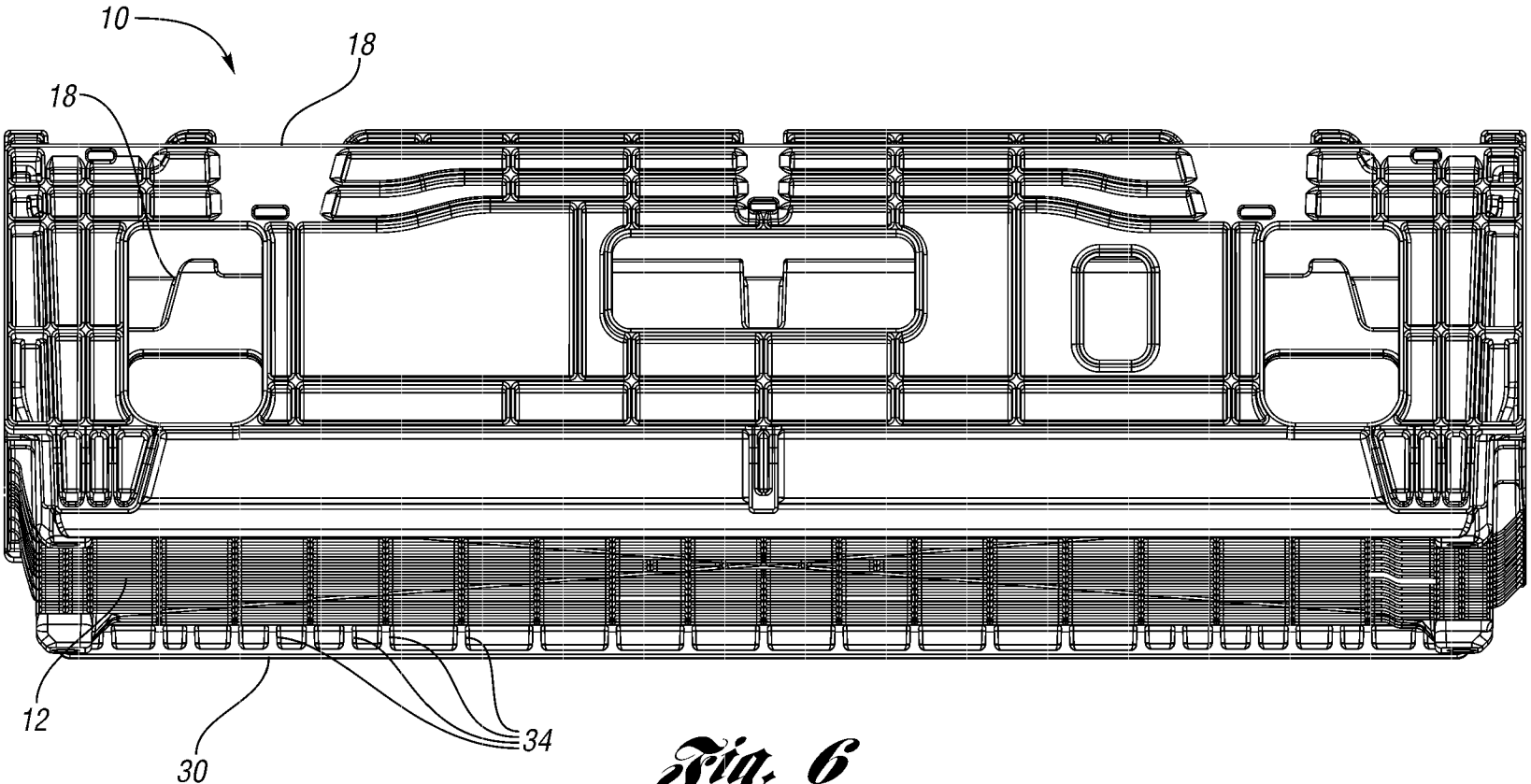
FIG. 6 is a side, bottom perspective view of the tray of FIG. 1.

FIG. 6 shows the underside of the base 12 of the tray 10. As shown, there are an increased number and concentration of short ribs 34 connecting the base 12 to the drag rail 30 near the corners of the tray 10. These short ribs 34 provide additional support when the tray is placed on a floor chain conveyor running parallel to the length of the tray 10.

Figure 7:
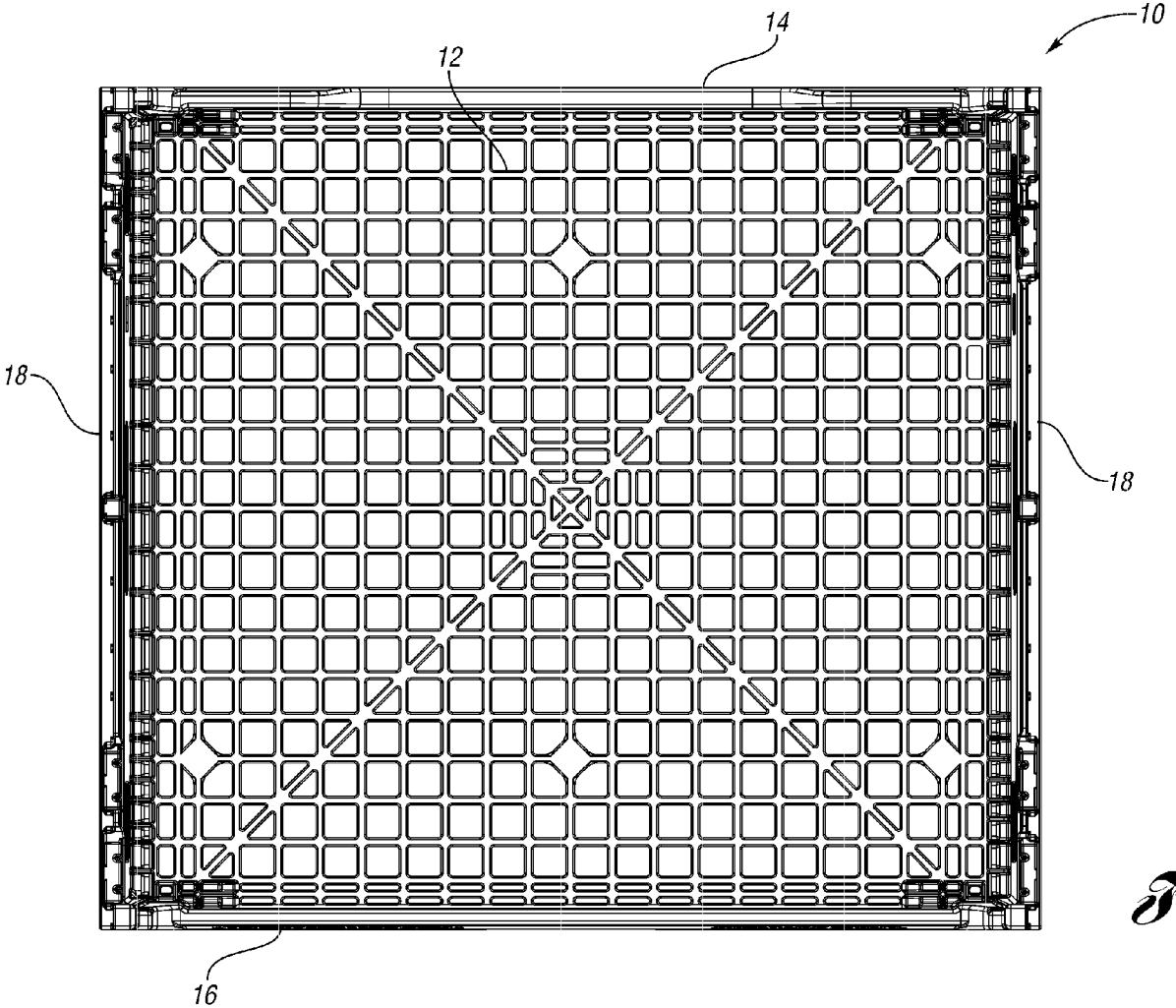
FIG. 7 is a top view of the tray of FIG. 1.
Figure 8:
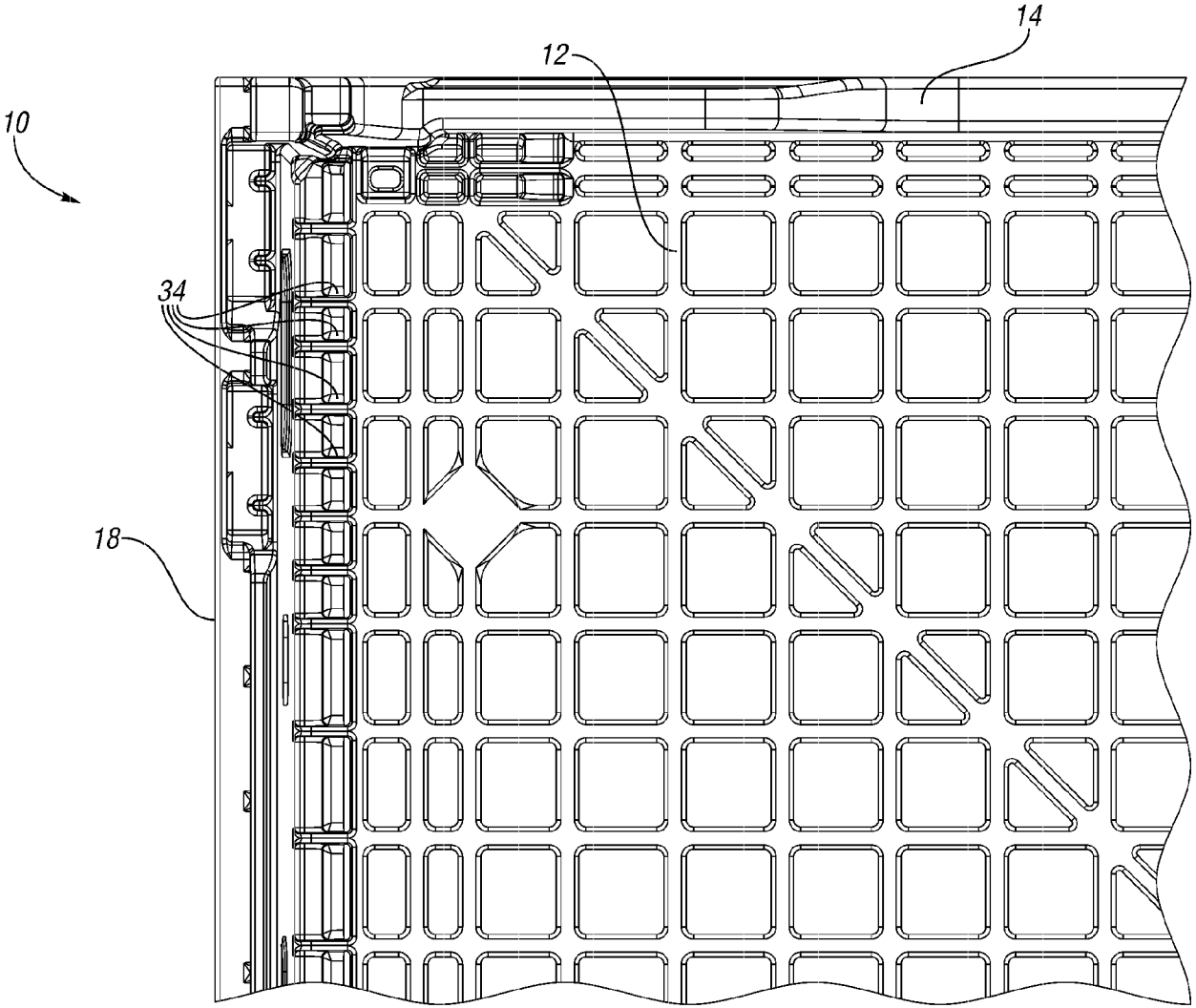
FIG. 8 is an enlarged view of one corner of the tray of FIG. 7.

FIG. 7 is a top view of the tray 10. FIG. 8 is an enlarged view of one corner of the tray of FIG. 7, showing the increased number of short ribs 34 connecting the base 12 to the drag rail 30 near the corners of the tray 10.

Figure 9:
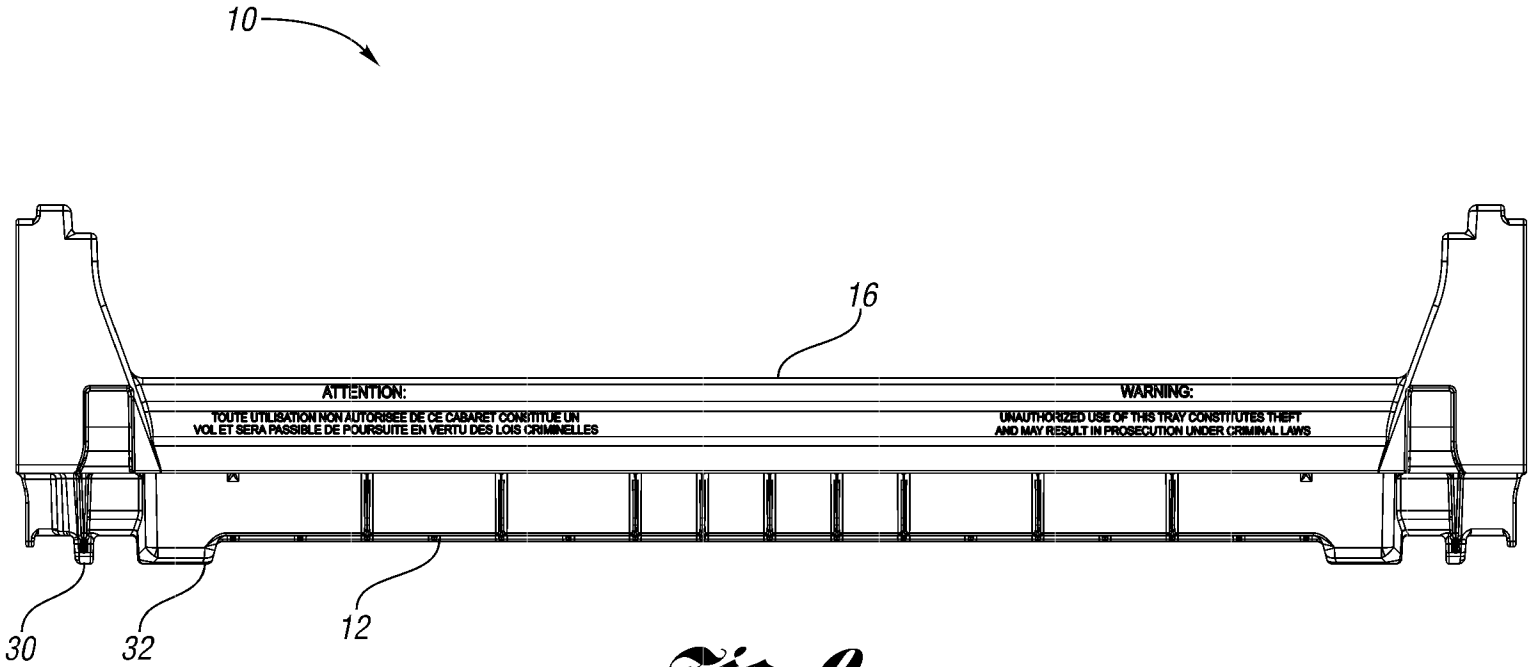
FIG. 9 is a rear view of the tray of FIG. 1.
Figure 10:
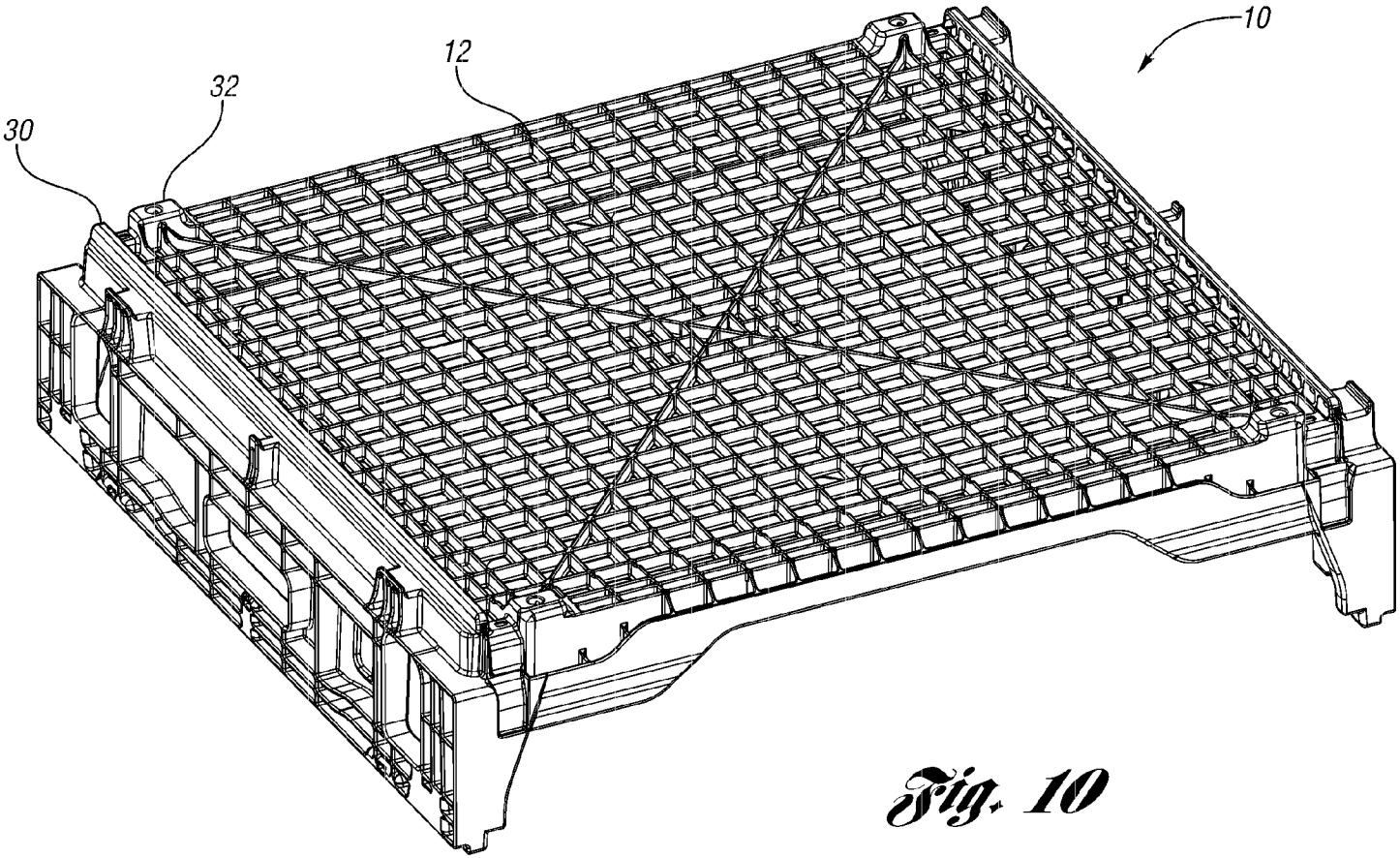
FIG. 10 is a bottom perspective view of the tray of FIG. 1.

As shown in FIGS. 9 and 10, the corner pads 32 protrude downward from the base 12 further than the drag rails 30 (for example, 0.03" more than the drag rails 30). As a result, the tray 10 will be dragged on the floor on the corner pads 32 which will wear before the drag rails 30. Protecting the drag rails 30 should extend the life of the tray 10.

As is commonly known, the entire tray 10 is preferably injection molded as a single-piece of plastic.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A bakery tray comprising:

a base;

a front wall extending upward from the base;

side walls extending upward from the base;

a rear wall extending upward from the base, the rear wall includes an inner panel portion and an outer lip portion that protrudes outward and then downward from an uppermost edge of the inner panel portion;

a plurality of first ribs connecting the inner panel portion to the outer lip portion, wherein the plurality of ribs includes an increased concentration of the first ribs in the center of the tray;

a drag rail extending downward below the base from each side wall;

a plurality of corner pads extending downward from the base between the drag rails, wherein the corner pads extend downward further than the drag rails; and a plurality of second ribs connecting the drag rails to the base.

2. The bakery tray of claim 1 wherein the rear wall is shorter than the side walls.

3. The bakery tray of claim 2 wherein the front wall has a dropped portion providing access to the tray.

4. The bakery tray of claim 1 wherein the plurality of second ribs includes an increased concentration of the second ribs toward corners of the tray.

5. A bakery tray comprising:

a base;

a front wall extending upward from the base;

side walls extending upward from the base;

a rear wall extending upward from the base, the rear wall includes an inner panel portion and an outer lip portion that protrudes outward and then downward from an uppermost edge of the inner panel portion;

a drag rail extending downward below the base from each side wall; and a plurality of ribs connecting the drag rails to the base, wherein the plurality of ribs includes an increased concentration of the second ribs toward corners of the tray.

6. The bakery tray of claim 5 wherein the rear wall is shorter than the side walls.

7. The bakery tray of claim 6 wherein the front wall has a dropped portion providing access to the tray.

8. The bakery tray of claim 7 further including a plurality of corner pads extending downward from the base between the drag rails.

9. The bakery tray of claim 8 wherein the corner pads extend downward further than the drag rails.

10. A bakery tray comprising:

a base;

a front wall extending upward from the base;

side walls extending upward from the base;

a rear wall extending upward from the base, the rear wall includes an inner panel portion and an outer lip portion that protrudes outward and then downward from an uppermost edge of the inner panel portion;

a drag rail extending downward below the base from each side wall;

a plurality of guide feet protruding outward from the drag rail; and a plurality of corner pads extending downward from the base between the drag rails, wherein the corner pads extend downward further than the drag rails.

11. The bakery tray of claim 10 wherein the rear wall is shorter than the side walls.

12. The bakery tray of claim 11 wherein the front wall has a dropped portion providing access to the tray.

* * * * *

UNITED STATES PATENT AND TRADEMARK OFFICE

CERTIFICATE OF CORRECTION

PATENT NO. : 8,561,832 B2
APPLICATION NO. : 13/543928
DATED : October 22, 2013
INVENTOR(S) : Jon P. Hassell It is certified that error appears in the above-identified patent and that said Letters Patent is hereby corrected as shown below:

IN THE CLAIMS:

In claim 5, column 3, line 30; delete "second"

Signed and Sealed this
Ninth Day of September, 2014

Michelle K. Lee

Michelle K. Lee
*Deputy Director of the United States Patent and Trademark Office*